United States Patent [19]

Owen, Jr.

[11] 4,083,559

[45] Apr. 11, 1978

[54] SPORTS TRAINING APPARATUS

[76] Inventor: George Owen, Jr., 23 Robbins St., Milton, Mass. 02186

[21] Appl. No.: 794,743

[22] Filed: May 9, 1977

Related U.S. Application Data

[63] Continuation of Ser. No. 647,331, Jan. 8, 1976, abandoned.

[51] Int. Cl.[2] ..... A63B 69/00

[52] U.S. Cl. ..... 273/26 A; 350/288

[58] Field of Search ..... 273/26 R, 26 A, 35 A, 273/54 D, 30, 183 E, 29 A; 35/29 R, 29 A, 29 F; 350/288

[56] References Cited

U.S. PATENT DOCUMENTS

| | | | |
|---|---|---|---|
| 2,978,246 | 4/1961 | Van Groningen | 273/26 A |
| 3,197,208 | 7/1965 | Makar | 273/26 A |
| 3,210,079 | 10/1965 | Tryon | 273/54 D |

OTHER PUBLICATIONS

Nancy Cartoon, Washington Daily News, Mar. 3, 1970, p. 42.

*Primary Examiner*—Anton O. Oechsle
*Attorney, Agent, or Firm*—Grover and Meegan

[57] ABSTRACT

Apparatus for training players in baseball and other sports employs a mirror which permits the player to view all his body movements while projecting the ball toward the mirror as a target. The apparatus comprises a shock resistant mirror which may be variously mounted for angular adjustment to permit the player a full body view of his image. One mount comprises a standard with a cross bar tiltingly suspending the mirror independently of a netting or like web surrounding the mirror. Tie members between the bottom of the mirror and the standard adjust the angle of the mirror so that the player sees his full image throughout natural delivery of the ball.

6 Claims, 4 Drawing Figures

SPORTS TRAINING APPARATUS

This is a continuation of application Ser. No. 647,331, filed Jan. 8, 1976, abandoned.

BACKGROUND OF THE INVENTION

Many sports involve the proper delivery of a ball or the like — tennis, golf, hockey and particularly baseball. In these sports critical body movements of the player determine his effectiveness and many instructions are available for improving a player's performance. But such instructions, even if given personally by a coach observing a player are not so effective or convincing as a player's observing his own motions. Mirrors have therefore been used to allow a player to watch his movements up to the point where he throws or otherwise projects the ball. Then, however, the player must stop the follow through of his natural motion or throw at a target outside his vision in the mirror. The value of his instruction and of his view in the mirror is then lost.

Accordingly one object of the present invention is to provide apparatus for training a ball player in the complete delivery of ball. Further objects are to provide a convenient and collapsible frame for the apparatus.

STATEMENT OF INVENTION

According to the invention sports training apparatus comprises a standard framework including a crossbar, a mirror assembly including a front surface of tempered glass resistant to the shock of a standard baseball at pitched velocity, means connecting the mirror assembly and crossbar including means tiltably suspending the mirror from the crossbar, and additional means for angular adjustment of the mirror with respect to a vertical plane so that a ball player can view his image while completing natural movements including projecting the ball upon the mirror at playing velocity.

DRAWINGS

DESCRIPTION

Figure 1:
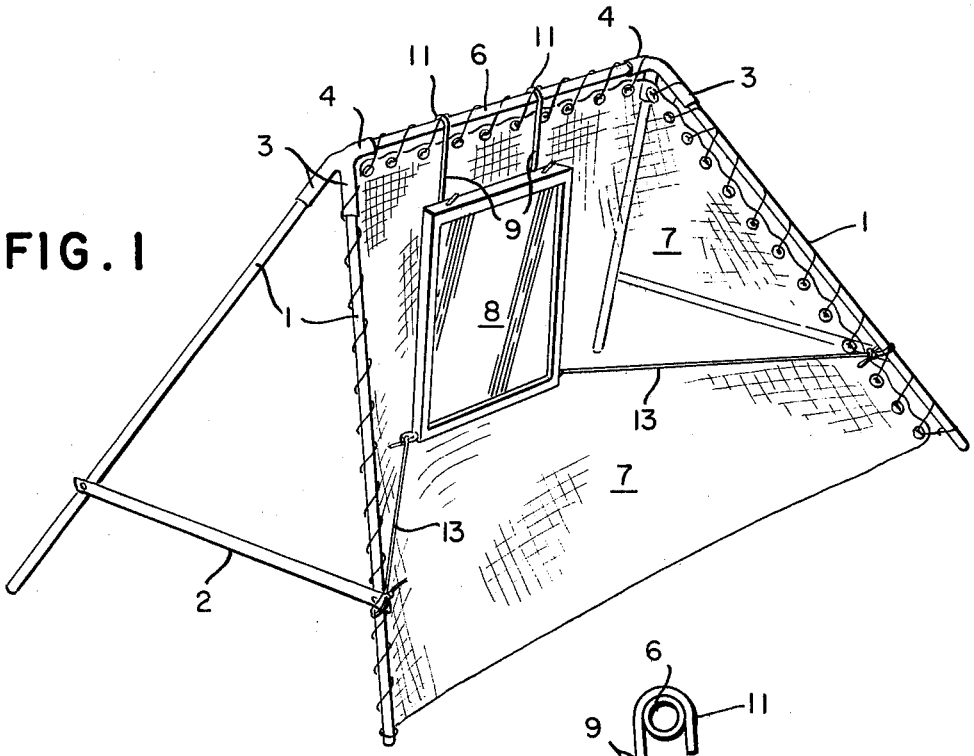
FIG. 1 is an isometric view of mirror training apparatus according to the invention.
Figure 2:
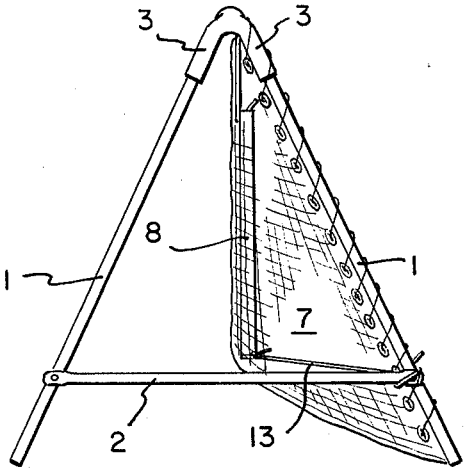
FIG. 2 is an end view of the apparatus.

As shown in FIGS. 1 and 2 training apparatus for baseball and like sports comprises a frame for standing on a playing ground, court or rink, including legs 1 forming two inverted vees, each connected by stringers 2. Each pair of legs fits slidably into sockets 3 of two folded Y shaped connectors each of which has a horizontal socket 4 receiving one end of a crossbar 6. One end of each stringer 2 is secured to a leg 1 by a wing nut and bolt so that the frame described may be collapsed by disengaging the legs 1 from the sockets 3 and the crossbar 6 from the sockets 4, and by detaching one end of each stringer 2 from one leg 1.

A web 7 of netting is laced or otherwise loosely attached at its upper and side edges to the crossbar 6 and two front legs 1, filling in the frame from the crossbar to the ground around the periphery of a specially designed mirror assembly 8, described hereinafter.

The mirror assembly 8 is suspended from the crossbar 6 by two rods 9 having crooks 11 at their upper ends loosely fitting over the crossbar 6 and angled hooks 12 engaging the top of the mirror assembly 9. The loose pivotting fit of the crooks over the crossbar allows the mirror assembly to be inclined at various angles with respect to a vertical plane through the crossbar. Tie cords 13 adjustably connect the lower corners of the mirror assembly 8 with the juncture of the front legs 1 and stringers 2. The netting 7 is loosely attached to the framework independently of the mirror assembly to allow mirror adjustment.

Typically the mirror is adjusted angularly forward so that a baseball player can see his full height while standing thirty feet away. At this distance his virtual image appears to be the sixty feet from the pitcher's box to plate on a standard baseball diamond. For this purpose the mirror assembly is inclined slightly forward.

Typical dimensions of the training apparatus are approximately 4 feet for the crossbar 6 length, 7 feet for the leg 1 length, 8 feet between the bottom of the legs, 3 feet stringer 2 length and 2 feet width and 3 feet height for the mirror assembly 8.

The mirror assembly in addition to the means for its tiltable suspension is particularly designed to be resistant to the shock of a standard baseball impacting at playing velocity of roughly ninety miles an hour maximum which is also a typical hockey puck velocity. Such a shock resistant mirror assembly 8 might be made of silvered ¾ inch tempered glass sold by Pittsburg Plate Glass Company under the trademark HERCULITE, but would weigh over 50 pounds and would not ordinarily be practical. On the other hand other materials such as acrylic plastic sheet while shock resistant are subject to scratching and heat warping.

Figure 3:
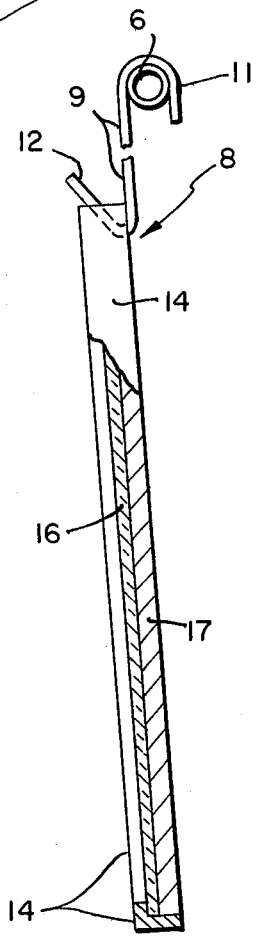
FIG. 3 is an elevation partly in section of a mirror of the invention.

IN FIG. 3 one preferred form of mirror assembly comprises a frame 14 of wood or metal securely holding a ¼ inch tempered HERCULITE mirror 16 backed by three quarters of an inch of five ply plywood 17.

Figure 4:
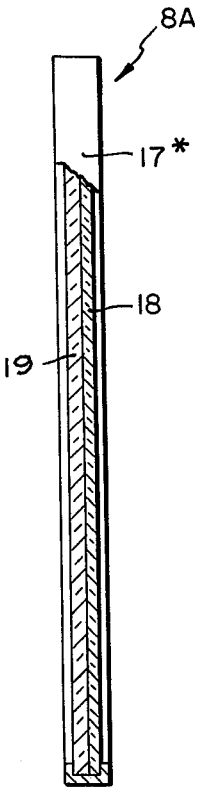
FIG. 4 is an elevation like FIG. 3 of an alternative mirror.

An alternative assembly shown in FIG. 4 comprises a frame 17* holding a conventional silvered plate glass mirror 18 faced with ¼ inch of unsilvered tempered glass 19.

As previously described the object of the present apparatus is to permit a player to complete all his motion, for example, in wind up and pitching a baseball at playing velocity. With the present apparatus the player can complete his motion including delivery of the ball at the mirror as a target simulating the strike zone of a batter. He can observe not only his natural motion but the accuracy with which he delivers the ball in the strike zone. And if he misses the strike zone the peripheral net stops the ball and avoids time lost in its retrieval.

It should be understood that the present disclosure is for the purpose of illustration only and that this invention includes all modifications and equivalents which fall within the scope of the appended claims.

I claim:

1. Sports training apparatus comprising:

a standard framework including a crossbar, a mirror assembly including a front surface resistant to the shock of a standard baseball at pitched velocity, means connecting the mirror assembly and crossbar including means tiltably suspending the mirror from the crossbar, and additional means for angular adjustment of the mirror with respect to a vertical plane so that a ball player can view his image while completing natural movements including projecting the ball upon the mirror at playing velocity, wherein the standard frames an area extending substantially peripherally of the mirror and including a web attached to the standard framework blocking passage of the ball through the peripheral area.

2. Apparatus according to claim 1 wherein the mirror assembly and web are independently attached to the standard framework so as to permit angular adjustment of the mirror independently of the web position.

3. Apparatus according to claim 1 wherein the standard frame includes members inclining the web with respect to the mirror.

4. Apparatus according to claim 1 wherein the standard framework and mirror connecting means are collapsible.

5. Apparatus according to claim 1 wherein the suspending means comprises hook means between the mirror assembly and crossbar.

6. Apparatus according to claim 1 wherein the mirror assembly includes a front surface of tempered glass.

* * * * *